US006428637B1

(12) United States Patent
Wood et al.

(10) Patent No.: US 6,428,637 B1
(45) Date of Patent: Aug. 6, 2002

(54) METHOD FOR PRODUCING LARGE TEAR-FREE AND CRACK-FREE NICKEL BASE SUPERALLOY GAS TURBINE BUCKETS

(75) Inventors: John H Wood, Ballston Spa, NY (US); David A Shores, Minneapolis, MN (US); Norman R Lindblad, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 08/479,350

(22) Filed: Jun. 7, 1995

Related U.S. Application Data

(63) Continuation of application No. 08/282,855, filed on Jul. 29, 1994, which is a continuation of application No. 07/760,825, filed on Sep. 17, 1991, now abandoned, which is a continuation of application No. 06/578,965, filed on Feb. 10, 1984, now abandoned, which is a continuation-in-part of application No. 06/128,481, filed on Mar. 10, 1980, now abandoned, which is a continuation-in-part of application No. 05/787,919, filed on Apr. 15, 1977, now abandoned, which is a continuation-in-part of application No. 05/489,408, filed on Jul. 17, 1974, now abandoned.

(51) Int. Cl.[7] ..... C22C 19/05
(52) U.S. Cl. ..... 148/555; 148/556
(58) Field of Search ..... 148/555, 556, 148/557

(56) References Cited

U.S. PATENT DOCUMENTS

| | | | | |
|---|---|---|---|---|
| 3,619,182 A | | 11/1971 | Bieber et al. | |
| 3,649,378 A | | 3/1972 | Kotval | |
| 3,807,993 A | | 4/1974 | Dalai et al. | |
| 3,904,382 A | | 9/1975 | Beltran et al. | |
| 4,063,939 A | | 12/1977 | Weaver et al. | |
| 4,080,201 A | | 3/1978 | Hodge et al. | |
| 4,145,481 A | | 3/1979 | Gupta et al. | |
| 4,302,256 A | | 11/1981 | Kenton | |
| 4,597,809 A | | 7/1986 | Duhl et al. | |
| 5,071,054 A | * | 12/1991 | Dzugan et al. | 228/119 |

FOREIGN PATENT DOCUMENTS

FR 2009771 2/1970

OTHER PUBLICATIONS

R.A. Sprague & M. Gell The potential for directionally–solidified turbine airfoils in marine gas turbine engines Summary of Preliminary Data Oct. 24, 1972.

(List continued on next page.)

*Primary Examiner*—George Wyszomierski
(74) *Attorney, Agent, or Firm*—Nixon & Vanderhye

(57) ABSTRACT

Method for producing a large, substantially hot tear-free superalloy gas turbine bucket useful in a large, land-based utility gas turbine engine, wherein a melt of a superalloy consisting essentially of, by weight:

| | |
|---|---|
| 13.7 to 14.3 | percent chromium, |
| 9.0 to 10.0 | percent cobalt, |
| 4.8 to 5.2 | percent titanium, |
| 2.8 to 3.2 | percent aluminum, |
| 2.8 to 4.3 | percent tungsten, |
| 1.0 to 1.5 | percent molybdenum, |
| 0.005 to 0.02 | percent boron, |
| 0 to 0.03 | percent zirconium, |
| 0.08 to 0.15 | percent carbon, and |

2.0 to 3.0 percent tantalum, or 1.0 to 1.5 percent columbium, or 2.0 to 2.5 percent hafnium, or 1.5 to 3.5 percent of a mixture of containing at least two of tantalum, columbium and hafnium, balance substantially nickel, is cast to produce said large gas turbine bucket.

17 Claims, 7 Drawing Sheets

OTHER PUBLICATIONS

D. Coutsouradis et al (editors). "High temperatures alloys for gas turbines" Sep. 1978.
Maurice Gell et al (editors). "Superalloys 1984" Oct. 7–11, 1984.
M.R. Winstone & J.E. Northwood. "Structure and Properties of directionally solidified superalloys in thin sections" 1980.
Comparacion Basica de las superaleaciones, Jul. 18, 1990.
Summary of Teleconference, Oct. 9, 1973. Reviewing INCO and DDA Activity Regarding in 792 Alloy, etc.
K.C. Antony. "Compositional Effects on microporosity" Jan. 15, 1974.
Hugh D. Hanes & John M. McFadden. "Hip'ing of castings: An update" Apr. 1983 (article printed in Metal Progress).
Shun–chi Minakata et al. "Manufacturing process of turbine disk materials by combination of eccentric rotating casting and forging processes", Japan 1991.
Metals Handbook, 8th Edition. vol. 5, 1970, pp. 237–261.
Goebel et al., *Metallurgical Transactions*, vol 4, Jan. 4, 1973, pp. 261–278.
Fawley. *Superalloy Progress,* The Superalloys, Sims & Hagel, (Wiley 1972) Chapter 1 pp. 3–29; Chapter 2, pp. 33–77 & Chapter 8, pp. 231–254.

* cited by examiner

METHOD FOR PRODUCING LARGE TEAR-FREE AND CRACK-FREE NICKEL BASE SUPERALLOY GAS TURBINE BUCKETS

This is a Rule 60 continuation of application Ser. No. 08/282,855, filed Jul. 29, 1994, which is a continuation of application Ser. No. 07/760,825, filed Sep. 17, 1991, now abandoned, which is a continuation of application Ser. No. 06/578,965, filed Feb. 10, 1984, now abandoned, which is a CIP of application Ser. No. 06/128,481, filed Mar. 10, 1980, now abandoned, which is a CIP of application Ser. No. 05/787,919, filed Apr. 15, 1977, now abandoned, which is a CIP of application Ser. No. 05/489,408, filed Jul. 17, 1974, now abandoned.

This is a continuation-in-part of our co-pending U.S. patent application, Ser. No. 128,481 filed Mar. 10, 1980, which is a continuation-in-part of our U.S. patent application, Ser. No. 787,919 filed Apr. 15, 1977 (now abandoned), which is a continuation of our U.S. patent application, Ser. No. 489,408 filed Jul. 17, 1974 (now abandoned), all of which are assigned to the assignee hereof.

The present invention relates in general to castable high-temperature alloys and is more particularly concerned with new cast nickel-base alloy articles having an unique combination of mechanical properties, stability characteristics and resistance to localized pitting and to ordinary hot corrosion in high-temperature corrosive environments. This invention is also concerned with a novel method by which sound castings of this alloy an be produced.

BACKGROUND OF THE INVENTION

A nickel-base alloy which has been used quite successfully in aircraft engine applications is disclosed and claimed in U.S. Pat. No. 3,615,376, issued Oct. 26, 1971 to Earl W Ross and assigned to the assignee hereof. A nickel-aluminide-type coating provides adequate protection from oxidation at high temperatures for buckets and other jet engine parts made of this alloy, but it has not been found that under substantially more severe environmental conditions resulting from use of alkali-metal-containing distillate or treated residual fuels, castings of articles of this alloy suffer catastrophic, localized corrosion or pitting. This mode of attack is unique among commercial nickel-base superalloys and is totally different from the hot corrosion attack which is characteristic of aircraft jet engine operation.

The merit of this special alloy compared to other nickel-base alloys is such that if this tendency toward pitting could be effectively eliminated even at the cost of some loss of overall hot corrosion resistance, the resulting alloy would still be very attractive for certain gas turbine applications.

SUMMARY OF THE INVENTION

This invention in both its method and article aspects is predicated upon several discoveries we have made and a basically new concept rooted in those discoveries. Thus, we have found that the localized, catastrophic, hot-corrosion attack to which nickel-base alloys of this type are vulnerable is associated with the localized concentrations of molybdenum and tungsten in the MC carbide phase. When these carbides are present at the surface of the alloy casting article, pitting can be initiated at those MC carbide sites. We have further found, however, that the amounts of molybdenum and tungsten are highly critical in producing this unusual corrosion effect and that the pitting tendency is effectively eliminated by reducing the combined total of molybdenum and tungsten in the carbide phase to less than about 15 percent. Additionally, we have found that such limitation of those two elements in the carbide phase can be readily accomplished without offsetting disadvantage or penalty to any desirable characteristic of the alloy through the addition of tantalum, columbium or hafnium or mixtures thereof. If used in combination, the amounts of these elements should aggregate in the range of 1.5 to 3.5 percent. If used individually, however, the amounts of these elements should preferably be in the following ranges:

| | |
|---|---|
| Tantalum | 2.0 to 3.0% |
| Columbium | 1.0 to 1.5% |
| Hafnium | 2.0 to 2.5% |

These maxima and minima are governed by microstructural stability and carbide control considerations, respectively.

These findings have led to the new concept of displacing molybdenum and tungsten from the carbide phase to the alloy matrix to bring the total of these elements as carbides below the critical upper limit. In method or process terms, this concept is implemented through the new step of adding the requisite amount of the displacing element to the alloy suitably, but not necessarily, at the melt stage.

Still further, we have found that by maintaining the aluminum to titanium ratio in these new alloys relatively low and by limiting their carbon and zirconium contents, it is possible to have in these alloys an unique combination of desirable properties including superior resistance to ordinary hot corrosion and castability enabling their use in the production of large land-based utility gas turbine bucket castings. Particularly, the ratio (Al/Ti) should be approximately three to five (3/5), the carbon content should be from 0.08 to 0.13 at most and the zirconium content should be 0.02 to 0.07 at most.

Another important discovery is that zirconium is not an essential component or constituent of these alloys. Thus their superior resistance to localized pitting and to ordinary hot corrosion is not diminished by eliminating zirconium from them. Likewise, the unique castability characteristic enabling their use in the production of cast, large heavy duty gas turbine components such as gas turbine buckets is not detrimentally effected by not adding zirconium to, or including zirconium in, the alloys. The maximum zirconium content of these alloys, however, remains unchanged at about 0.07% as originally set forth in patent application Ser. No. 489,408 and detailed herein below.

DETAILED DESCRIPTION OF THE INVENTION

A cast, nickel-base, superalloy article of this invention has an unique combination of mechanical properties, microstructural stability characteristics and resistance to localized pitting. In a preferred form, this article also has resistance to general hot corrosion and is readily produced as a sound casting in the form of a large land-based utility gas turbine bucket. These characteristics are attributable to the unique composition of the alloy and also to the method by which it is produced. In compositional terms, the alloys of this invention combining all the above desirable properties consist essentially of 13.7 to 14.3 percent chromium, 9 to 10 percent cobalt, 4.8 to 5.2 percent titanium, 2.8 to 3.2 percent aluminum, 2.8 to 4.3 percent tungsten, 1.0 to 1.5 percent molybdenum, 0.005 to 0.2 percent boron, 0.02 to 0.07 percent zirconium, 0.08 to 0.13 percent carbon, and 1.5 to 3.5 percent of tantalum, columbium or hafnium or mixtures thereof, or 2.0 to 3.0 percent tantalum, or 1.0 to 1.5 percent columbium, or 2.0 to 2.5 percent hafnium, balance nickel. Further, these alloys in the form of castings or articles such as gas turbine buckets are characterized by a matrix, a precipitate, and a monocarbide (MC) phase which consists of tantalum, titanium, molybdenum and tungsten in proportions such that the combined total of molybdenum and tungsten in the carbide constitutes less than about 15 percent of the carbide phase.

Alternatively, as indicated above, alloys of this invention having all those desirable properties in combination differ in composition from that stated just above in that they contain essentially no zirconium, that is, they are substantially free of zirconium, being formuated without addition of zirconium and therefore contain no more than trace amounts thereof.

According to the method of this invention, the novel nickel-base superalloy article generally described above is made by first preparing an ingot of the composition in the amounts stated above. As a second step, the ingot is remelted and cast to a form of the size and shape of the desired article. As the final step in the production of the preferred form of the article of this invention, the article is heat-treated in a vacuum or a neutral atmosphere, suitably in accordance with the appropriate time and temperature heat-treatment schedule.

BRIEF DESCRIPTION OF THE DRAWINGS

The similarities as well as the differences between the products or articles of this invention and those of the prior art are apparent from the drawings accompanying and forming a part of this specification, in which.

The corrosion test results represented by FIGS. 1–5 were obtained in an experiment involving the investment casting of a five-pound ingot of Rene 80, a commercially-available nickel-base super-alloy disclosed and claimed in the U.S. Pat. No. 3,615,376, referenced above, which has the following nominal composition:

| | |
|---|---|
| Cobalt | 9.5% |
| Chromium | 14.0 |
| Aluminum | 3.0 |
| Titanium | 5.0 |
| Molybdenum | 4.0 |
| Tungsten | 4.0 |
| Boron | 0.015 |
| Carbon | 0.17 |
| Zirconium | 0.03 |
| Nickel | Balance |

The ingot was sectioned and corrosion discs were subjected to heat treatment which consisted of heating for two hours at 2225° F. (vacuum) and then for four hours at 2000° F. (vacuum) and then for four more hours at 1925° F. (vacuum) and finally for 16 hours at 1550° F. in argon. Some of the corrosion discs were then coated with sodium sulfate (0.5 milligram per square centimeter) and hung with an unsalted disc in a pot furnace at 1700° F. in air. The furnace liner, a closed-end mullite tube, contained a few grams of molten sodium sulfate and the temperature of the furnace and the position of the samples were adjusted so that the reservoir salt was at a temperature as high as or slightly higher than corrosion discs throughout the heating period. The air in the furnace was saturated with salt, retarding evaporation of the coating.

Figure 1:
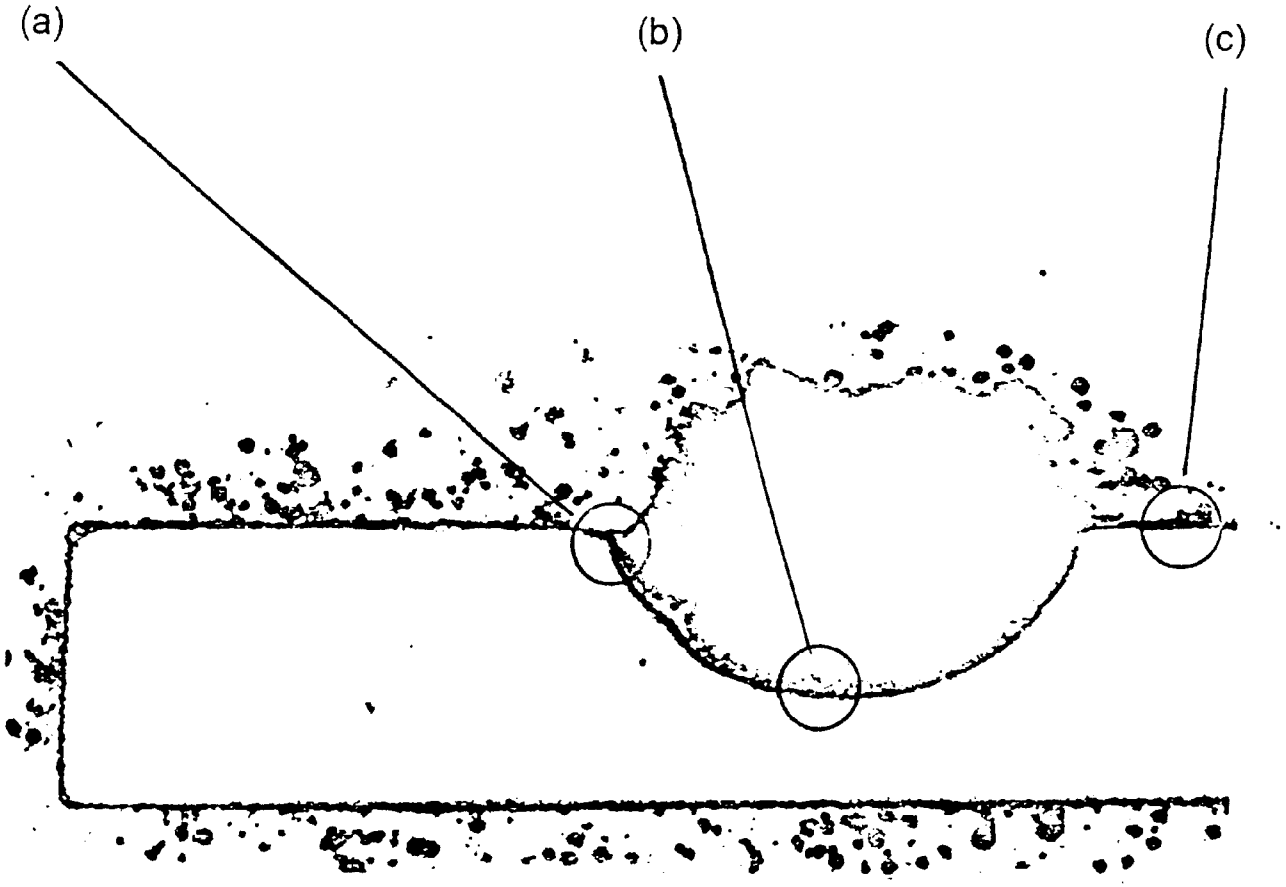
FIG. 1 is a photomicrograph of a portion of a nickel-base superalloy specimen exhibiting the effect of localized hot corrosion attack (magnification 25 diameters)
Figure 2:
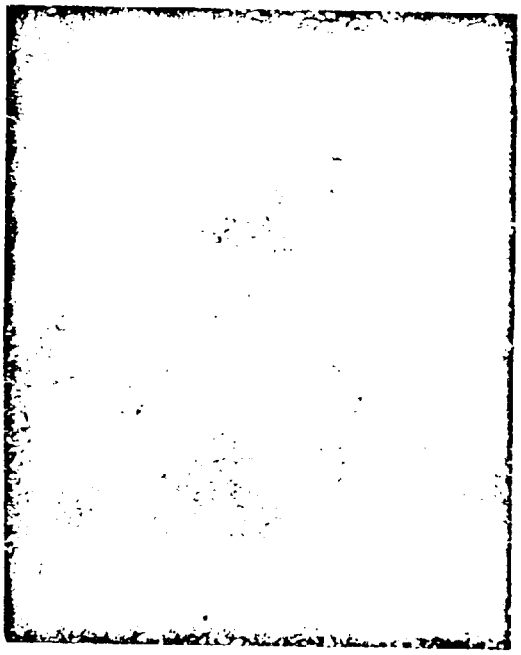
FIG. 2 is an X-ray scanning image photograph showing the concentration of tungsten at point (b) in the scale of the blister formed by the localized attack.
Figure 3:
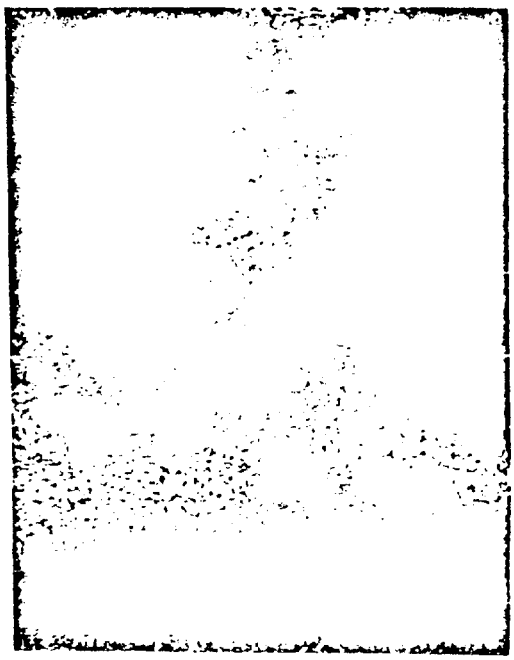
FIG. 3 is a photograph like that of FIG. 2 showing the concentration of molybdenum at point (b)
Figure 4:
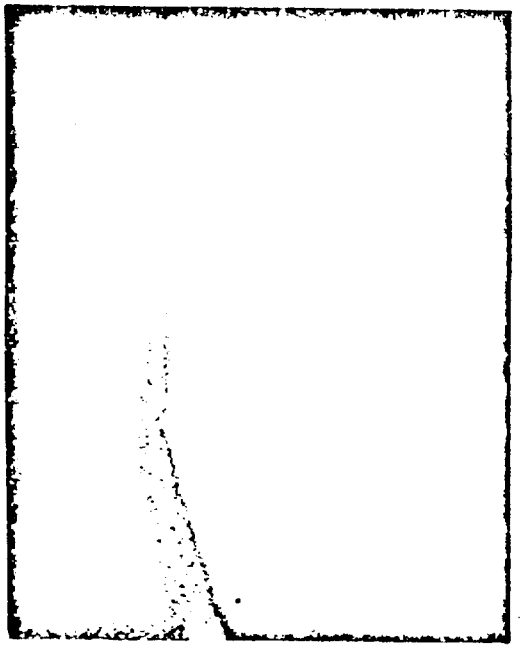
FIG. 4 is a photograph like that of FIG. 2 showing the concentration of tungsten at point (a) in the scale.
Figure 5:
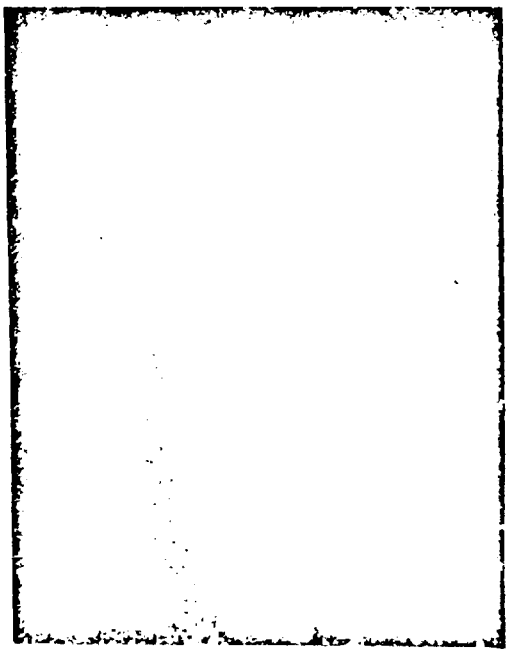
FIG. 5 is another photograph like that of FIG. 2 showing the concentration of molybdenum at point (a)
Figure 6:
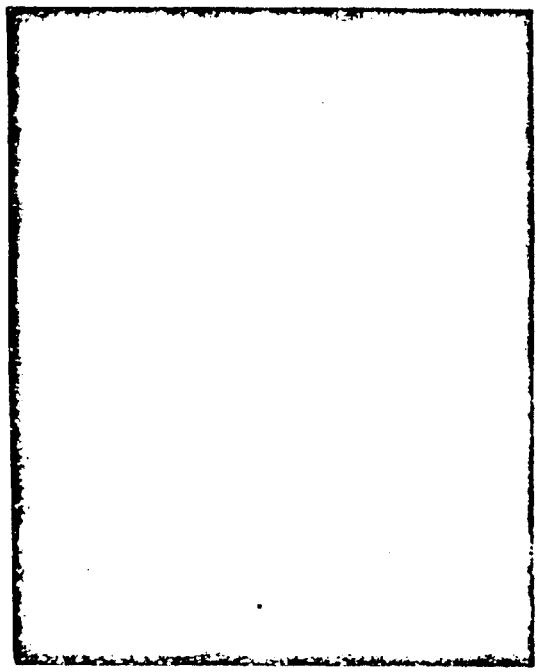
FIG. 6 is still another photograph like that of FIG. 2 revealing the absence of tungsten in the scale at point(c) in the normally attacked region of the specimen.
Figure 7:
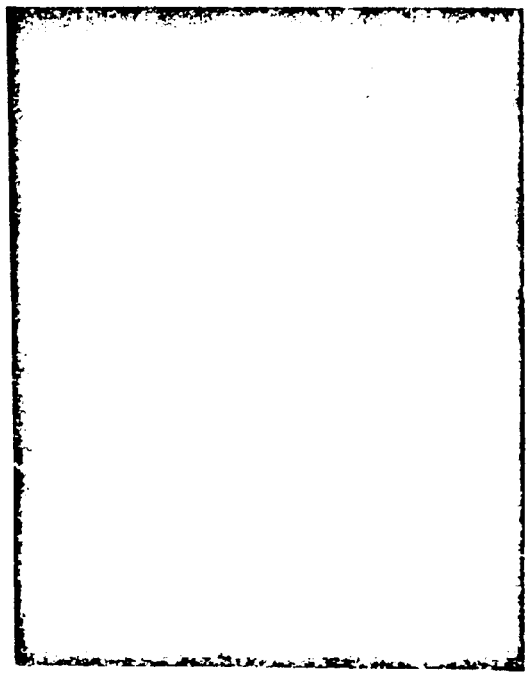
FIG. 7 is another photograph like that of FIG. 2 revealing the absence of molybdenum in the scale at point (c)

Upon removal from the furnace, salt-coated discs exhibited substantial attack with localized penetration typically as shown in FIG. 1. The unsalted disc, however, proved to be quite resistant to this accelerated oxidation test and exhibited only a thin oxide scale and no localized penetration or pitting.

The same test performed on other commercial alloys such as IN-733 and IN-792 did not develop pits, which is consistent with burner rig experience and supports the conclusion that this accelerated test is effective for inducing localized corrosion of susceptible alloys and, consequently, for distinguishing the susceptible from the non-susceptible. On that basis, corrosion disc test specimens of the alloys of Table I were prepared as described above for the same test.

TABLE I

| Alloy Designation | Co | Cr | Al | Ti | Mo | W | Ta | B | Zr | C | Ni |
|---|---|---|---|---|---|---|---|---|---|---|---|
| A | 9.5 | 14 | 3 | 5 | 4 | 4 | 0.5 | .016 | .03 | .15 | Bal. |
| B | " | " | " | " | 3.5 | " | 1.0 | " | " | " | " |
| C | " | " | " | " | 3 | " | 1.5 | " | " | " | " |
| D | " | " | " | " | 2.5 | " | 2.0 | " | " | " | " |
| E | " | " | " | " | 2 | " | 2.5 | " | " | " | " |
| F | " | " | " | " | 1.5 | " | 3.0 | " | " | " | " |

Distribution of molybdenum, tungsten, tantalum and titanium in the carbide phases of Rene 80 and each of the Table I alloys is set forth in Table II together with the results of the burner rig and accelerated oxidation tests.

TABLE II

| | Carbide (Wgt %) | | | | | Pitting |
|---|---|---|---|---|---|---|
| | Ti | Ta | W | Mo | (Mo + W) | Attack |
| Rene 80 | 51 | — | 18 | 18 | 36 | Yes |
| A | 43 | 13 | 19 | 11 | 30 | Yes |
| B | 36 | 24 | 18 | 8 | 26 | Yes |

TABLE II-continued

| | Carbide (Wgt %) | | | | | Pitting |
|---|---|---|---|---|---|---|
| | Ti | Ta | W | Mo | (Mo + W) | Attack |
| C | 36 | 31 | 12 | 6 | 18 | Yes |
| D | 32 | 40 | 11 | 4 | 15 | Possible |
| E | 31 | 45 | 10 | 3 | 13 | No |
| F | 27 | 48 | 12 | 2 | 14 | No |

On the basis of these results, further tests were made for the purpose of optimizing the composition in terms of the ultimately desired combination of mechanical and corrosion-resistance properties. Thus, a total of 18 additional alloys constituting modifications of alloys D and F were prepared generally as described above, being cast as one-inch by four-inch by five-inch slabs at 1900° F. mold temperature and 225° F. metal superheat. The nominal composition of each of these alloys is set out in Table III.

TABLE III

| Alloy | Ni | Co | Cr | Al | Ti | Mo | W | Ta | Cb | Hf | B | Zr | C |
|---|---|---|---|---|---|---|---|---|---|---|---|---|---|
| G | Bal. | 9.5 | 14 | 3 | 5 | — | 4 | 3 | — | — | .015 | .03 | .12 |
| H | Bal. | 9.5 | 14 | 3 | 4.7 | 1 | 4 | 3 | — | — | " | " | " |
| I | Bal. | 9.5 | 14 | 3 | 5 | 1 | 4 | 2.5 | — | — | " | " | " |
| J | Bal. | 9.5 | 14 | 3.2 | 4.7 | 1.25 | 4 | 2.5 | — | — | " | " | " |
| K | Bal. | 9.5 | 14 | 3.3 | 5 | 1 | 4 | 2.5 | — | — | " | " | " |
| L | Bal. | 9.5 | 14 | 3.2 | 5 | 1.25 | 4 | 3 | — | — | " | " | " |
| M | Bal. | 9.5 | 14 | 3 | 5 | 4 | 1 | 2.5 | — | — | " | " | " |
| N | Bal. | 9.5 | 14 | 3 | 5 | 2 | 3 | 2.5 | — | — | " | " | " |
| O | Bal. | 9.5 | 14 | 3 | 5 | 1.5 | 4 | — | 1.5 | — | " | " | " |
| P | Bal. | 9.5 | 14 | 3 | 5 | 1 | 4 | 2 | 0.5 | — | " | " | " |
| Q | Bal. | 9.5 | 14 | 3 | 5 | 1 | 4 | 0.5 | 1.5 | — | " | " | " |
| R | Bal. | 9.5 | 14 | 3 | 5 | 1 | 4 | 2 | — | 0.5 | " | " | " |
| S | Bal. | 9.5 | 14 | 3 | 5 | 1.5 | 4 | — | — | 2.5 | " | " | " |
| T | Bal. | 8.5 | 15.5 | 3 | 4.5 | 1 | 4 | 2.5 | — | — | " | " | " |
| U | Bal. | 9.5 | 15.5 | 3 | 4.3 | 1 | 3.5 | 2.5 | — | — | " | " | " |
| W | Bal. | 9.5 | 14 | 3 | 5 | 2.5 | 4 | 2 | — | — | " | " | .15 |
| X | Bal. | 9.5 | 14 | 3 | 5 | 1.5 | 4 | 3 | — | — | " | " | .15 |
| Y | Bal. | 9.5 | 14 | 3 | 5 | 1.5 | 4 | 3 | — | — | " | " | .13 |

Most of these slabs were heat treated as described above except that the first step involved heating at 2150° F., rather than 2225° F., as noted in Table IV.

The slabs were then sectioned and evaluated metallographically and standard tensile, rupture and corrosion disc specimens were machined and tested.

The tensile properties of all except the T and U alloys were quite good. Thus, room temperature and 1200° F. test results were similar to what might be expected for thick sections of standard Rene 80 superalloy, there being no significant difference in tensile strength or yield strength between the two sets of alloys. Ductility of the alloys was, in general, slightly improved with the 2150° F. solution heat treatment.

Figure 8:
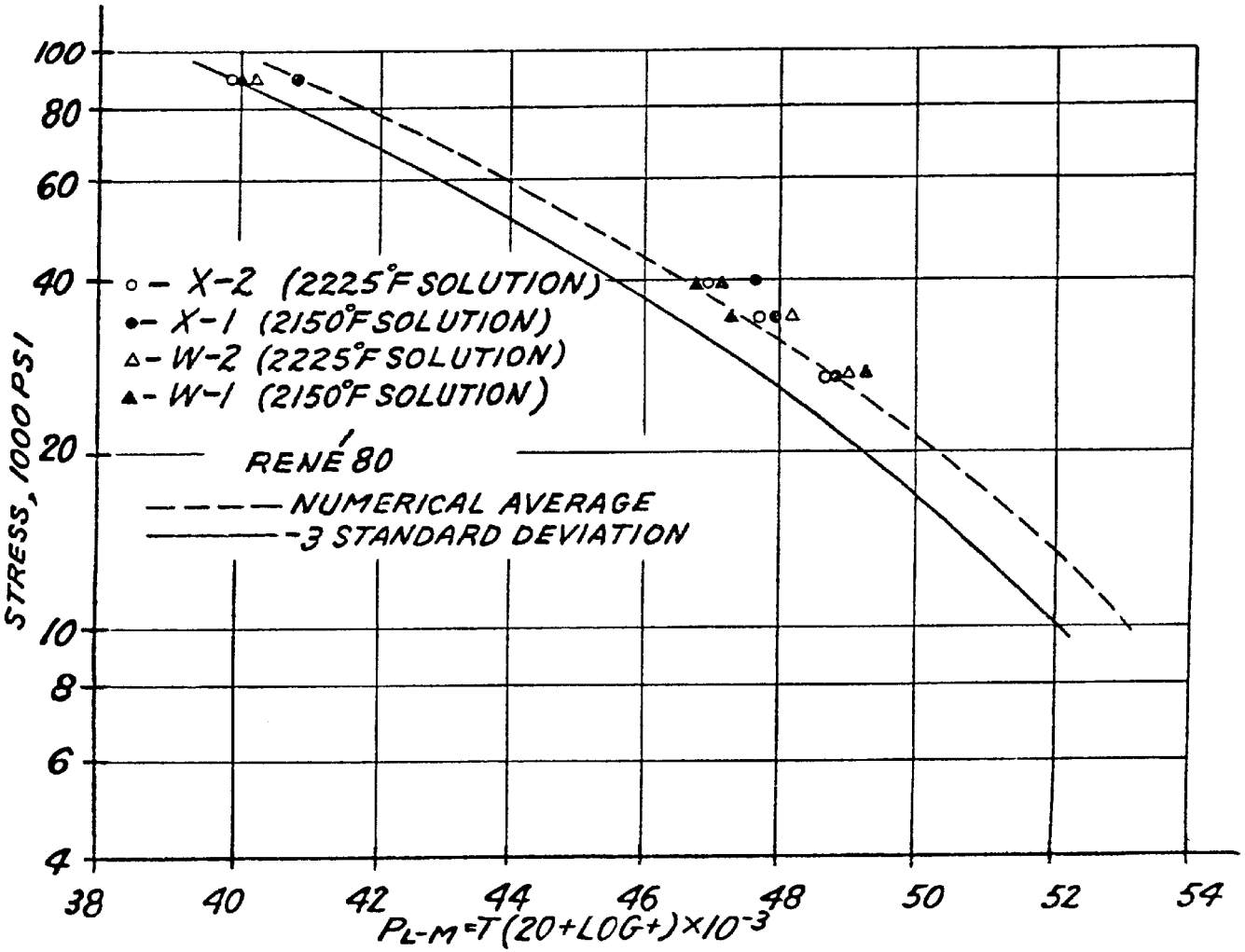
FIG. 8 is a Larson-Miller plot of the stress-rupture properties of nickel-base superalloys, including two alloys of the present invention.
Figure 9:
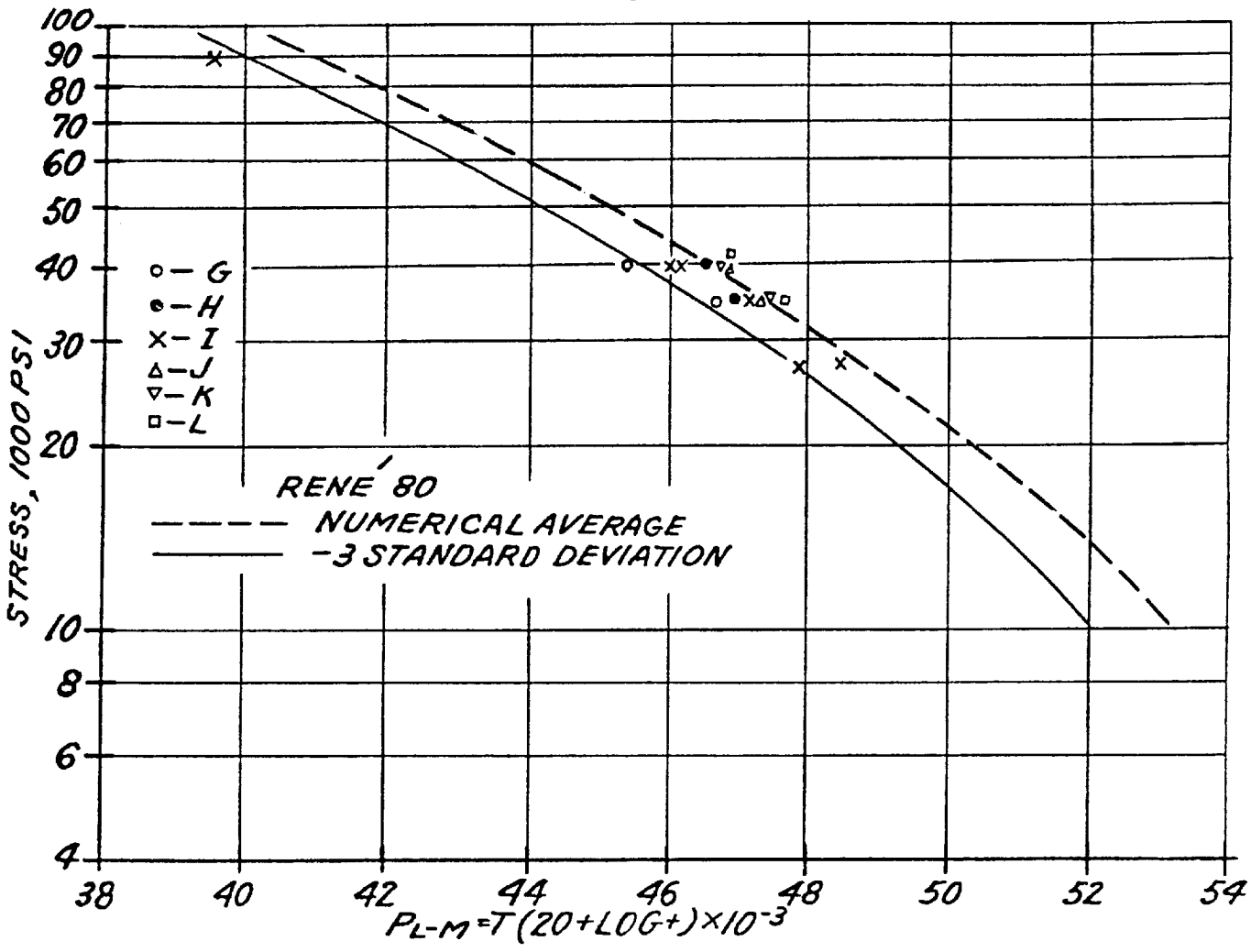
FIG. 9 is a Larson-Miller plot like that of FIG. 8 of several additional alloys of this invention.
Figure 10:
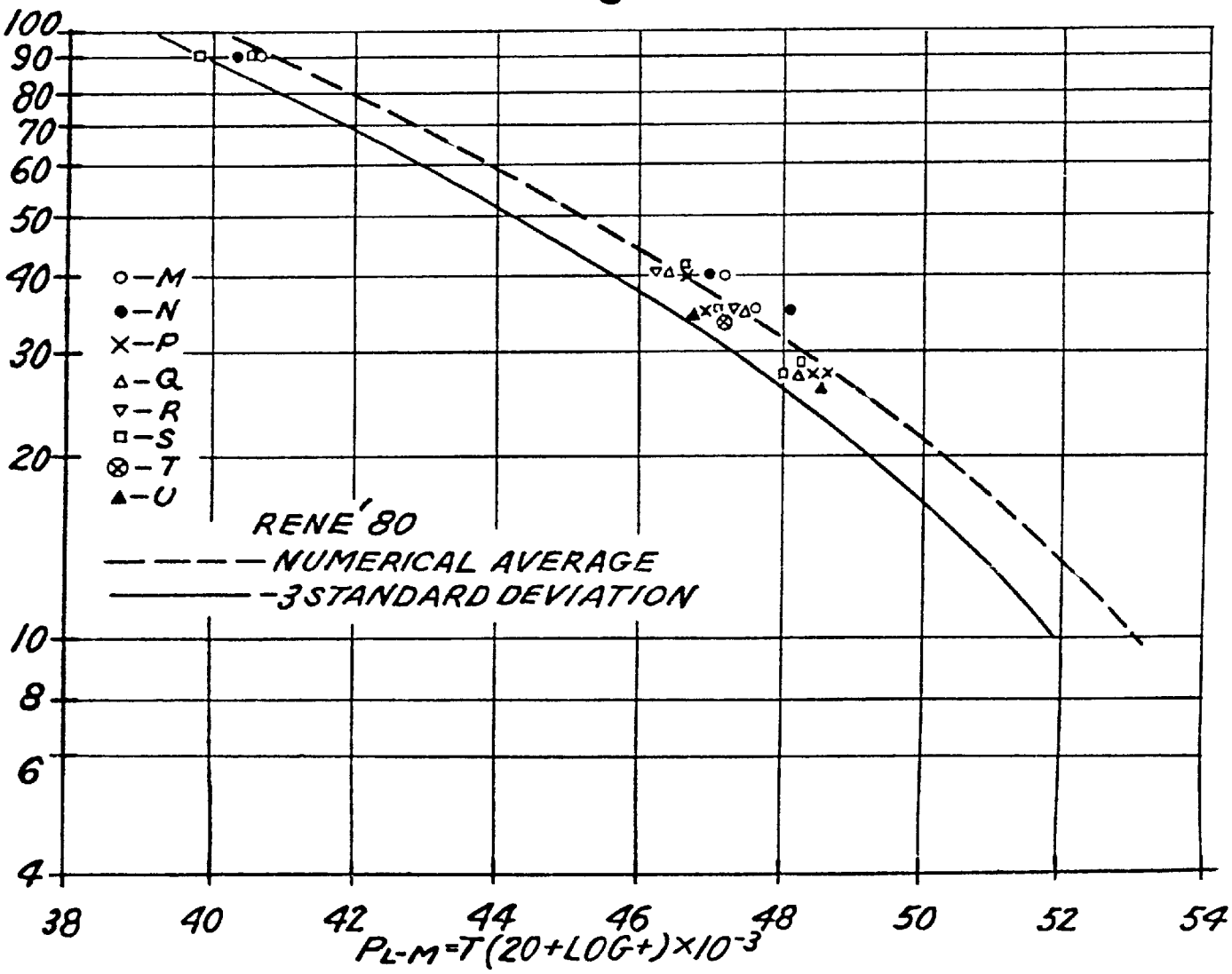
FIG. 10 is a third Larson-Miller plot of still other alloys of this invention.

The results of preliminary rupture testing of these alloys are set out in Table IV and are shown graphically on the Larson-Miller charts of FIGS. 8, 9 and 10, Rene 80 curves again being used for comparison.

TABLE IV

| Alloy* | Temp. (° F.) | Stress (ksi) | Life (hrs) | (PL-M) | Elongation Percent | RA Percent |
|---|---|---|---|---|---|---|
| G | 1600 | 40 | 109.0 | (45.4) | 2.9 | 3.8 |
| H | " | " | 367.2 | (46.5) | 5.1 | 7.4 |

TABLE IV-continued

| Alloy* | Temp. (° F.) | Stress (ksi) | Life (hrs) | (PL-M) | Elongation Percent | RA Percent |
|---|---|---|---|---|---|---|
| I | " | " | 215.5 | (46.0) | 3.3 | 6.4 |
| J | " | " | 527.7 | (46.8) | 4.8 | 7.2 |
| K | " | " | 471.1 | (46.7) | 4.4 | 5.8 |
| L | " | " | 556.7 | (46.8) | 4.3 | 9.0 |
| M | " | " | 803.9 | (47.2) | 7.5 | 13.7 |
| N | " | " | 653.1 | (47.0) | 7.2 | 9.3 |
| P | " | " | 438.3 | (46.05) | 6.5 | 8.5 |
| Q | " | " | 340.6 | (46.4) | 5.1 | 9.9 |
| R | " | " | 286.3 | (46.25) | 5.9 | 13.7 |
| S | " | " | 434.4 | (46.65) | 8.1 | 9.8 |
| I | 1400 | 90 | 37.7 | (40.4) | 6.2 | 10.0 |
| N | " | " | 64.4 | (40.6) | 6.0 | 9.3 |
| S | " | " | 57.2 | (40.5) | 9.3 | 27.0 |
| W-1 | 1800 | 27.5 | 42.2 | (48.9) | 10.6 | 20.0 |
| W-2 | " | " | 54.9 | (49.1) | 6.4 | 15.0 |
| X-1 | " | " | 32.2 | (48.6) | 6.8 | 15.0 |

TABLE IV-continued

| Alloy* | Temp. (° F.) | Stress (ksi) | Life (hrs) | (PL-M) | Elongation Percent | RA Percent |
|---|---|---|---|---|---|---|
| X-2 | " | " | 33.0 | (48.7) | 3.1 | 6.4 |
| Y | " | " | 33.1 | (48.8) | 3.1 | 6.4 |
| W-1 | 1600 | 40 | 660.0 | (47.0) | 9.2 | 15.0 |
| W-2 | " | " | 528.2 | (46.8) | 4.8 | 16.7 |
| X-1 | " | " | 594.6 | (46.9) | 4.9 | 12.0 |
| X-2 | " | " | 1280.1 | (47.6) | 4.8 | 7.2 |
| Y | " | " | 1275.5 | (47.5) | 4.8 | 7.2 |
| W-1 | 1600 | 35 | 2560.9 | (48.2) | 6.6 | 9.0 |
| W-2 | " | " | 867.4 | (47.3) | 6.9 | 10.0 |
| X-1 | " | " | 1509.2 | (47.7) | 3.8 | 6.4 |
| X-2 | " | " | 1862.1 | (47.9) | 5.8 | 7.0 |
| Y | " | " | 1868.2 | (47.9) | 5.8 | 7.0 |
| W-1 | 1400 | 90 | 34.3 | (40.1) | 13.9 | 24.0 |
| W-2 | " | " | 29.1 | (40.0) | 6.6 | 18.0 |
| X-1 | " | " | 27.7 | (39.9) | 4.2 | 19.0 |
| X-2 | " | " | 83.0 | (40.8) | 5.7 | 12.0 |
| Y | " | " | 83.5 | (40.9) | 5.7 | 12.0 |

*W-1 and X-1 series differ from the other series only in that the solution heat treatment step temperature was 2225° F. instead of 2150° F.

As Illustrated by FIGS. 8–10, the properties of the alloys of this invention are generally excellent at 1600° F. and 1800° F., most of the test points falling around the average for Rene 80 and two points at 1600° F./40 ksi lying one full parameter above the Rene 80 average. Rupture lives at 1400 F./90 ksi fall well below the Rene 80 average except for two cases (alloy Y and alloy X, 2150° F. solution temperature) of coincidence. Rupture ductilities are generally lower than those of Rene 80 but not so low as to be of serious concern by themselves.

Corrosion tests carried out on these specimens were of three types. Accelerated oxidation tests as described above were run up to 1700 hours with no signs of pitting attack despite the presence of many carbides near the sample surface. Alloy M, however, proved to be poorer by both the accelerated oxidation test and the electrochemical test, which indicates that molybdenum should be minimized in these alloys for best corrosion-resistance properties.

Electrochemical screening tests likewise yielded encouraging results, corrosion rates being approximately equivalent to that of alloy IN-738. Thus, for example, predicted penetration values (mils per 600 hours exposure at 1600 F) were 2.2 mils for alloy W and 4.4 mils for alloys X and Y, as compared to 3.3 mils for IN-738 and 7.7 mils for Rene 80.

Burner rig tests carried out at 1600° F. and 1800° F. on test specimens of most of the experimental alloys (including Rene 80) yielded results set forth in Table V.

TABLE V

| Alloy | Temp. (° F.) | Time (Hrs) | Penetration (mils) Maximum | Penetration (mils) Average |
|---|---|---|---|---|
| G-1 | 1600 | 651 | 1.55 | 0.6 |
| G-2 | ↓ | 1002 | 12.35 | 8.85 |
| H-1 | ↓ | 651 | 4.7 | 1.9 |
| H-2 | ↓ | 1034 | 3.55 | 1.8 |
| I-1 | ↓ | 651 | 1.35 | 0.45 |
| I-2 | ↓ | 1022 | 10.4 | 6.7 |
| J-1 | ↓ | 651 | 1.2 | 0.4 |
| J-2 | ↓ | 1010 | 6.7 | 2.5 |
| K-1 | ↓ | 614 | 3.6 | 0.95 |
| K-2 | ↓ | 1010 | 9.0 | 6.0 |
| L-1 | ↓ | 614 | 3.8 | 1.4 |
| L-2 | ↓ | 605 | 22.2 | 15.1 |
| M-1 | ↓ | 581 | 10.35 | 8.75 |
| M-2 | ↓ | 1010 | 1.6/15.9 | 0.5/9.9 |
| N-1 | ↓ | 651 | 1.25 | 0 |
| N-2 | ↓ | 1022 | 9.4 | 5.8 |
| P | ↓ | 629 | 9.95 | 5.1 |
| Q | ↓ | 603 | 1.3 | 0.6 |
| R | ↓ | 651 | 1.75 | 0.6 |
| S | ↓ | 651 | 2.2 | 1.2 |
| W-1 | ↓ | 618 | 4.85 | 1.45 |
| W-4 | ↓ | 657 | 31.6 | 31.6/16.0 |
| X-1 | ↓ | 608 | 6.15 | 2.9 |
| X-2 | ↓ | 1008 | 5.4 | 2.1 |
| Rene 80 | ↓ | 611 | 4.0 | 0.65 |
| " | ↓ | 650 | 11.7/3.65 | 7.50/0.57 |
| " | ↓ | 1092 | 7.40/1.60 | 1.20/0.50 |
| " | ↓ | 1017 | 5.7 | 1.7 |
| H-5 | 1800 | 608 | 9.65 | 5.5 |
| K-5 | ↓ | 600 | 6.75 | 3.75 |
| L-5 | ↓ | 608 | 3.9 | 2.5 |
| L-7 | ↓ | 786 | 20.2/31.7 | 17.2 |
| W-1 | ↓ | 611 | 4.0 | 2.6 |
| W-6 | ↓ | 1007 | 12.35 | 6.4 |
| W-7 | ↓ | 1133 | 11.9 | 5.9 |
| X-7 | ↓ | 1012 | 6.8 | 4.4 |
| Rene 80 | ↓ | 507 | 17.8/31.9 | 3.1 |
| " | ↓ | 884 | 17.97 | 9.53 |
| " | ↓ | 458 | 18.18/31.9 | 8.73/31.9 |

These tests were conducted in a manner such that the specimens were exposed to an atmosphere generated from the combustion of a #2 diesel oil containing 1.0 percent sulfur to which was added 125 parts per million of sodium in the form of synthetic sea salt. The fuel was combusted in the air to fuel ratios normally found in a gas turbine, and the resultant combustion product was flowed past the specimens at approximately 70 feet per second at one atmosphere pressure. The specimens (discs of one inch diameter and 60 mils thickness) were maintained at the combustion gas temperature throughout the test period.

The sample specimens subjected to these burner rig tests were sectioned, mounted and examined metallographically to determine the depth of penetration of the hot corrosion attack. The occurrence of a second number at some points in the table indicates that the two sides of the specimen exhibited very different rates of attack as, for example, where one side contains a localized pit and the attack has proceeded all the way through the specimen, while the other shows only normal surface attack. The large amount of attack on part of samples W-4 and M-2 did not occur as a classical pit, but was an overall corrosion which occurred for an unknown reason.

The fact that pits have not been detected in any of these alloys, with the exception of Rene 80, during these tests is considered to be very important. In addition to the advantages thus to be gained as set out above, this will enable much more accurate prediction of the corrosion rate in service.

Since patent application Ser. No. 489,408 was filed, many additional burner rig tests have been carried out on alloy Y and such tests have also been made of alloys 1 and 5 of Table I of U.S. Pat. No. 3,619,182, issued Nov. 9, 1971 to Bieber et al. All these tests were carried out in the manner and under the conditions described above so that the results obtained are directly comparable. The Bieber et al alloys, however, were prepared by vacuum melting five pound heats and vacuum casting one-inch by four-inch long cylinders subsequently heat treated as described in the Bieber et al -182 patent. The cylinders were thereafter machined into the standard corrosion disc form for burner rig testing. The data developed in thus testing the Bieber et al alloys are set forth in Table VI together with data representing our accumulated experience in such testing of alloy Y under the same conditions.

TABLE VI

HOT CORROSION BURNER RIG DATA FOR BIEBER ALLOYS

| Alloy | Temp. (° F.) | Time (Hrs) | Penetration (mils) Maximum | Penetration (mils) Average |
|---|---|---|---|---|
| Bieber #1 | 1600 | 643 | 31.4+ | 31.4+ |
| | ↓ | 429 | 31.4+ | 31.4+ |
| | ↓ | 166 | 19.6 | 17.4 |
| | ↓ | 735 | 31.4+ | 31.4+ |
| | ↓ | 150 | 25.45 | 21.7 |
| | ↓ | 1012 | 31.4+ | 31.4+ |
| Bieber #5 | 1600 | 643 | 31.4+ | 24.7 |
| | ↓ | 407 | 31.4+ | 31.4+ |
| | ↓ | 880 | 7.1 | 5.2 |
| | ↓ | 877 | 31.4+ | 31.4+ |
| | ↓ | 900 | 31.4+ | 31.4+ |
| | ↓ | 502 | 22.9 | 21.2 |
| Y | 1600 | 610 | 6.2 | 4.1 |
| | ↓ | 670 | — | 4.8 |
| | ↓ | 1000 | 5.4 | 2.1 |
| | ↓ | 1050 | 11.1 | 8.7 |
| | ↓ | 1250 | — | 11.5 |
| | ↓ | 1350 | — | 4.8 |
| | ↓ | 2000 | 9.3 | 1.4 |
| | ↓ | 2050 | 18.0 | 15.0 |
| | ↓ | 2350 | — | 24.0 |
| | ↓ | 2800 | — | 20.5 |

TABLE VI-continued

HOT CORROSION BURNER RIG DATA FOR BIEBER ALLOYS

| Alloy | Temp. (° F.) | Time (Hrs) | Penetration (mils) Maximum | Penetration (mils) Average |
|---|---|---|---|---|
| | ↓ | 3000 | 20.3 | 18.4 |
| | ↓ | 3300 | — | 25.0 |
| Bieber #1 | 1800 | 645 | 10.1 | 8.1 |
| | ↓ | 593 | 2.4 | 1.8 |
| | ↓ | 602 | 31.4+ | 17.2 |
| | ↓ | 2006 | 6.0 | 4.5 |
| | ↓ | 690 | 27.2 | 24.0 |
| | ↓ | 2636 | 13.0 | 12.1 |
| Bieber #5 | ↓ | 551 | 7.1 | 4.3 |
| | ↓ | 599 | 9.2 | 6.4 |
| | ↓ | 1035 | 2.6 | 1.8 |
| | ↓ | 2017 | 6.6 | 5.0 |
| | ↓ | 1485 | 31.4+ | 28.4 |
| | ↓ | 1734 | 4.5 | 3.8 |
| Y | 1800 | 600 | — | 3.6 |
| | ↓ | 625 | 4.7 | 4.1 |
| | ↓ | 1000 | — | 5.1 |
| | ↓ | 1020 | 6.7 | 4.5 |
| | ↓ | 1050 | 20.3 | 20.0 |
| | ↓ | 1650 | — | 18.5 |
| | ↓ | 2000 | 21.5 | 2.9 |
| | ↓ | 2050 | 17.5 | 13.5 |
| | ↓ | 2200 | — | 16.0 |
| | ↓ | 3000 | — | 11.5 |

While the compositional differences between our alloy Y and Bieber et all alloys 1 and 5 would not appear to be important, the actual effect of then can be quite dramatic with respect to the usability of these alloys in gas turbine engine parts, as indicated by the hot corrosion characteristics stated in Table VI. Thus, at 1600° F., which is a realistic large land-based utility gas turbine operating temperature, alloy Y vastly outperforms Bieber et al alloys 1 and 5. Even at 1800 F. where burner rig conditions tend more toward oxidation than to hot corrosion, our alloy Y shows less data scatter and generally performs at least as well as those two Bieber et al alloys. In more specific terms, it is apparent from Table VI that eight of the twelve Biever et al alloys 1 and 5 were totally destroyed in the 1600° F. test (the 31.4+ designation) in 1000 hours or less, but none of the alloy Y test specimens were destroyed in the same test in times as long as 3300 hours. Further, in the same 1600° F. test, the data points of 11 of the 12 Bieber et al alloys 1 and 5 test specimens fall outside the scatter band of the alloy Y data points. Still further, on an average basis, the corrosion penetration after 1000 hours of this same test was at least five times greater for the Bieber et al alloys 1 and 5 than for alloy Y, which represents a major increase in corrosion performance.

The aluminum-titanium ratio is the critical factor accounting for these different properties, that of the Bieber et al alloys 1 and 5 being ⅘, while that of alloy Y is approximately 3/5 and this lower ratio, we believe, promotes hot corrosion resistance. Thus Bieber et al alloys 4 and 6 are also represented by these tests.

With regard to castability, we have found that casting soundness is not a problem with alloys of this invention, particularly when the carbon and zirconium contents are maintained at or below the maxima stated above, specifically 0.13 percent carbon and 0.07 percent zirconium. Such is not the case, however, with some prior art alloys which because of certain compositional characteristics cannot be used to cast large land-based utility gas turbine buckets to which the alloys of this invention are directed. In particular, attempts to cast such buckets of alloys such as alloys 2 and 3 of Table I of the Bieber et al -182 patent have been consistently unsuccessful and to our knowledge no one uses such alloys in producing gas turbine blades because they tend to hot tear during solidification and tend to hot crack during heat treatment due to their relatively high carbon (0.18 percent) content and high zirconium (0.10 percent) content. These findings and conclusions stand on the results of tests carried out by Howmet Turbine Components Corporation at the request of the assignee hereof to compare the castability of our alloy Y with the castability of alloys 2 and 3 of Table I of the Bieber et al -182 patent. In performing these tests, each alloy was cast into MS 7000U second stage bucket molds under identical standard casting conditions and the resulting total of 10 bucket castings were processed through standard manufacturing operations including the usual full heat treatment, then subjected to nondestructive testing. More specifically, two small heats (less than 100 pounds) of each of Bieber et al alloys 2 and 3 and one heat of the same size of our alloy Y were formulated and one mold consisting of two bucket castings each was poured from each of the five small heats to produce the total of ten castings. The heat chemistries are set out in Table VII.

TABLE VII

Test Alloy Heat Compositions

| | Bieber et al Alloy 2 | | Bieber et al Alloy 3 | | Alloy Y |
|---|---|---|---|---|---|
| | Heat A | Heat B | Heat A | Heat B | Heat A |
| Ni | Bal. | Bal. | Bal. | Bal. | Bal. |
| Co | 9.99 | 9.95 | 10.13 | 10.16 | 9.5 |
| Cr | 13.19 | 13.22 | 11.03 | 11.17 | 14.0 |
| Mo | 1.98 | 1.97 | 1.96 | 1.97 | 1.3 |
| W | 3.90 | 3.91 | 4.16 | 3.81 | 3.85 |
| Cb | 0.01 | 0.02 | 0.51 | 0.53 | <0.1 |
| Ta | 3.89 | 3.90 | 4.01 | 4.06 | 2.8 |
| Al | 2.96 | 2.98 | 2.96 | 2.95 | 2.9 |
| Ti | 4.43 | 4.37 | 4.85 | 4.92 | 4.78 |
| C | 0.18 | 0.18 | 0.17 | 0.18 | 0.08 |
| Fe | 0.01 | 0.08 | 0.07 | 0.08 | 0.06 |
| Si | 0.03 | 0.04 | 0.04 | 0.05 | <0.1 |
| Mn | 0.01 | 0.01 | 0.01 | 0.01 | <0.1 |
| Cu | 0.01 | 0.01 | 0.01 | 0.01 | <0.1 |
| B | 0.020 | 0.025 | 0.021 | 0.019 | 0.016 |
| Zr | 0.06 | 0.08 | 0.09 | 0.08 | <0.02 |
| P | 0.005 | 0.001 | 0.001 | 0.001 | — |
| S | 0.001 | 0.001 | 0.001 | 0.001 | 0.0012 |
| V | 0.01 | 0.02 | 0.02 | 0.02 | — |
| Hf | 0.01 | 0.01 | 0.01 | 0.01 | <0.1 |
| Pb | 1 PPM | 1 PPM | 1 PPM | 1 PPM | 1 PPM |
| Bi | 0.2 PPM | 0.1 PPM | 0.1 PPM | 0.1 PPM | 0.3 PPM |
| Ag | <2 PPM | <2 PPM | <2 PPM | <2 PPM | <5 PPM |
| Se | 0.5 PPM | 0.5 PPM | 0.5 PPM | 0.5 PPM | 0.5 PPM |
| Te | <0.5 PPM | <0.5 PPM | <0.5 PPM | <0.5 PPM | <0.5 PPM |
| Tl | <0.5 PPM | <0.5 PPM | <0.5 PPM | <0.5 PPM | <0.5 PPM |
| Mg | 7 PPM | 10 PPM | 10 PPM | 9 PPM | 3 PPM |
| $N_2$ | 10 PPM | 10 PPM | 7 PPM | 8 PPM | — |
| $O_2$ | 20 PPM | 16 PPM | 22 PPM | 16 PPM | — |

Further in specific terms insulating, preheating and casting of the molds were all uniform and standard, the mold temperature in each instance being 2000° F. and the melt temperature likewise being 230° F. above the alloy melting point temperature. Following casting, the parts were processed through shell removal, cutoff, cleaning, gate removal, heat treatment, fluorescent penetrant inspection and radiographic inspection. The heat treatment of each test casting consisted of solution treatment at 2050° F. in vacuum for two hours, followed by aging for twenty-four hours at 1550° F. in vacuum.

After shell removal, it was immediately apparent that significant cracking had occurred in all test castings of Bieber et al alloys 2 and 3. In fact four of the eight castings of alloys 2 and 3 were missing shrouds due to enormous airfoil cracks occurring near the shrouds. By contrast, no cracking had occurred in the alloy Y test castings. Radiographic inspection revealed no more than slight internal microshrinkage in the airfoils of the test castings, but severe cracks were evident in every one of the castings of Bieber et al alloys 2 and 3 while none were evident in any of the alloy Y castings.

Fluorescent penetrant inspection was performed on all these test castings prior to and subsequent to full heat treatment, but no surface preparation was performed on any of these castings between the heat treatment and this inspection. Numerous cracks were revealed in all the Bieber et al alloy 2 and 3 castings and they occurred at many locations on the airfoils, including both radii and flat areas. In addition, there were a minimum of two hot tears and a maximum of eleven hot tears in these alloy 2 and 3 castings. By contrast, again, no cracks were found in the alloy Y castings and neither were any hot tears found in them.

As proven by these tests, there is a real and important difference in castability between the Bieber et al -182 patent alloys 2 and 3 and those of the present invention exemplified by alloy Y.

Experimental evidence supporting the concept that zirconium is an optional, rather than an essential constituent of these novel alloys of ours was derived from exploratory work carried out as detailed in the following account:

Investment cast slabs 1 in.×4 in.×5 in. of nickel-base alloy were produced under identical conditions (1900° F. mold preheat, 225° F. metal superheat at pour) to avoid differences in the solidification rate produced by various casting parameters. The zirconium levels investigated were 0.10%, 0.04% and zero (no intentional addition). The remainder of the alloy composition was as follows:

| | |
|---|---|
| Chromium | 16.0% |
| Cobalt | 8.5% |
| Aluminum | 3.5% |
| Titaniun | 3.4% |
| Molybdenum | 1.5% |
| Tungsten | 2.6% |
| Tantalum | 1.75% |
| Columbium | .9% |
| Carbon | .17% |
| Boron | .01% |
| Nickel | Balance |

The single exception .to this formulation was that the heat containing 0.04% zirconium also contained only 0.12% carbon. Test bars of 0.252 in. diameter gauge section were machined from these slabs for mechanical property evaluation. The standard heat treatment (2050° F. for two hours plus 1550° F. for twenty-four hours) was utilized on all slabs. Rupture testing over the temperature range 1600–1800 F with exposure times ranging from less than 100 hours to greater than 600 hours were performed on each composition. Limited tensile testing was performed at room temperature and 1200° F. on each composition. The results of the physical testing of these samples are shown below in Table VIII in which rupture results are set forth and Table IX in which tensile test results are stated.

TABLE VIII

Rupture Results

| Zirconium Level Wgt. % | Temp. ° F. | Stress KSI | Life Hrs. | % EL | % RA |
|---|---|---|---|---|---|
| 0.10 | 1800 | 22 | 72.1 | 13.0 | 28.0 |
| 0.10 | 1800 | 22 | 42.1 | 9.5 | 15.0 |
| 0.10 | 1800 | 22 | 57.6 | 5.4 | 24.0 |
| 0.10 | 1600 | 40 | 227.4 | 11.1 | 12.0 |
| 0.10 | 1600 | 40 | 259.1 | 12.0 | 12.0 |
| 0.10 | 1600 | 35 | 580.8 | 8.4 | 13.0 |
| 0.10 | 1600 | 35 | 517.1 | 6.9 | 14.0 |
| 0.10 | 1600 | 35 | 530.8 | 6.1 | 9.9 |
| 0.10 | 1600 | 35 | 667.4 | 9.8 | 15.0 |
| 0.10 | 1525 | 55 | 88.4 | 12.4 | 22.0 |
| 0.04 | 1800 | 22 | 63.8 | 13.5 | 19.0 |
| 0.04 | 1800 | 22 | 60.1 | 10.9 | 18.0 |
| 0.04 | 1600 | 40 | 206.2 | 7.4 | 12.0 |
| None | 1850 | 10 | 606.1 | 11.3 | 12.0 |
| None | 1800 | 15 | 252.8 | 8.6 | 23.0 |
| None | 1800 | 22 | 56.8 | 6.8 | 12.0 |
| None | 1700 | 22 | 587.7 | 11.3 | 12.0 |
| None | 1625 | 35 | 205.9 | 7.1 | 9.9 |
| None | 1600 | 35 | 467.4 | 4.9 | 7.2 |
| None | 1600 | 35 | 442.9 | 5.4 | 7.7 |
| None | 1525 | 55 | 81.3 | 8.3 | 12.0 |
| None | 1500 | 55 | 145.8 | 6.1 | 7.7 |

TABLE IX

Tensile Results

| Zirconium Level Wgt. % | Temp. ° F. | UTS KSI | 0.2% YS KSI | % EL | % RA |
|---|---|---|---|---|---|
| 0.10 | Room | 129.1 | 111.2 | 3.1 | 10.6 |
| 0.10 | Room | 128.3 | 113.5 | 2.4 | 7.0 |
| 0.10 | Room | 121.5 | 110.4 | 3.0 | 8.5 |
| 0.04 | Room | 140.0 | 117.2 | 6.8 | 15.4 |
| 0.04 | Room | 127.0 | 113.5 | 5.0 | 14.5 |
| None | Room | 128.5 | 106.5 | 3.8 | 7.6 |
| 0.10 | 1200 | 151.0 | 103.2 | 7.2 | 13.6 |
| 0.04 | 1200 | 152.2 | 112.4 | 8.9 | 12.8 |
| None | 1200 | 119.2 | 84.5 | 5.1 | 12.4 |

No crack was found on visual inspection of the cast slabs prior to the rupture and tensile tests. Further, there is no reason to believe that either the resistance to general hot corrosion or the resistance to localized pitting is affected to any extent by varying the zirconium content as was done in this test series. Still further, the results obtained through these tests afford a sound basis for concluding that the alloys of the present invention which have the unique combination of mechanical properties, microstructural stability characteristics and resistance to localized pitting, general hot corrosion in high temperature corrosive environment and excellent castability, would likewise not be detrimentally affected by entirely eliminating their zirconium content.

Regarding the rupture and tensile strength results set out in Tables V and VI, there are some differences between the alloys containing zirconium and those having essentially none. Those differences, however, are relatively small and appear in general to be well within acceptable limits which means that the alloy producer has freedom of choice as to whether or not to add zirconium.

Further, as a general proposition, it should be recognized that even though zirconium is not intentionally added to the alloys of this invention, there may be zirconium present in small amounts of the order of parts per million that may, for example, be a consequence of the addition of hafnium to the alloy because zirconium and hafnium naturally occur together and are not always separated into a chemically pure state prior to use in alloy production. Such small amounts of zirconium, as indicated previously, are inconsequential, being in the nature of an incidental inpurity and having no effect upon the important properties of the alloy.

Summarizing, this invention contemplates the use of a small but critical amount of tantalum, columbium, or hafnium or mixture thereof to reduce the molybdenum and tungsten in the carbide phase so as to eliminate the pitting attack on certain nickel-base superalloys of superior mechanical properties. The amount of tantalum or alternative should not be in excess of that which will produce significant microstructural instability (i.e., about 3.5 percent) and should not be less than that necessary to produce the new results of this invention (i.e., about 1.5 percent for mixtures and about 1.0 percent for columbium, 2.0 percent for hafnium and 2.0 percent for tantalum used individually). This invention further contemplates combining uniquely in these superalloys the properties of superior resistance to ordinary hot corrosion and castability enabling their use in the production of sound large land-based utility gas turbine bucket castings which are hot tear free and crack free in their normal heat treated condition.

Whenever in this specification and the appended claims proportions, percentages or amounts are stated, reference is to the weight basis unless otherwise specifically indicated.

What we claim as new and desire to secure by Letters Patent of the United States is:

1. A process for producing a large, hot tear-free and crack-free superalloy gas turbine bucket useful in a large, land-based utility gas turbine engine, said process comprising the steps of:

providing a melt of a superalloy conisisting essentially of, by weight:

| | |
|---|---|
| 14.0 | percent chromium, |
| 9.0 to 10.0 | percent cobalt, |
| 4.8 to 5.2 | percent titanium, |
| 2.8 to 3.2 | percent aluminum, |
| 2.8 to 4.3 | percent tungsten, |
| 1.0 to 1.5 | percent molybdenum, |
| 0.005 to 0.02 | percent boron, |
| 0 to 0.03 | percent zirconium, |
| 0.08 to 0.13 | percent carbon, and |
| 2.0 to 3.0 | percent tantalum, or 1.0 to 1.5 percent columbium, or 2.0 to 2.5 percent hafnium, |
| or | 1.5 to 3.5 percent of at least two of tantalum, columbium and hafnium, balance substantially nickel; and |

casting said melt to produce said large turbine bucket.

2. A method according to claim 1, wherein said casting step comprises investment casting said melt.

3. A method according to claim 1, including the step of heat treating the resulting gas turbine bucket by heating it to about 2050° F. in vacuum for about two hours and then aging said bucket for about 24 hours at about 1550° F. in vacuum.

4. A method according to claim 1, wherein said melt consists essentially of, by weight:

| | |
|---|---|
| 14.0 | percent chromium, |
| 9.5 | percent cobalt, |
| 2.9 | percent aluminum, |
| 4.8 | percent titanium, |
| 1.3 | percent molybdenum, |
| 3.8 | percent tungsten, |
| 2.8 | percent tantalum, |
| 0.016 | percent boron, |
| 0.08 | percent carbon, |
| up to 0.02 | percent zirconium, and |
| | balance substantially nickel. |

5. A method according to claim 1, wherein the melt consists essentially of, by weight:

| | |
|---|---|
| 14.0 | percent chromium, |
| 9.5 | percent cobalt, |
| 3.0 | percent aluminum, |
| 5.0 | percent titanium, |
| 1.5 | percent molybdenum, |
| 4.0 | percent tungsten, |
| 3.0 | percent tantalum, |
| 0.015 | percent boron, |
| 0.13 | percent carbon, |
| 0.03 | percent zirconium, and |
| | balance substantially nickel. |

6. A method according to claim 1, wherein said superalloy consists of (1) a matrix, (2) a γ'-precipitate and (3) a monocarbide phase distributed through said matrix, said carbide phase consisting of titanium, molybdenum and tungsten together with a metal selected from the group consisting of tantalum, columbium, hafnium and mixtures thereof in proportions such that the total of molybdenum and tungsten does not exceed about 15% of the total metal content of the carbide phase, the aluminum/titanium ratio in said superalloy being about ⅗, the amount of tantalum in said superalloy being up to about 3%.

7. A method according to claim 1, wherein said melt consists essentially of:

| | |
|---|---|
| 14.0 | percent chromium, |
| 9.5 | percent cobalt, |
| 2.9 | percent aluminum, |
| 4.8 | percent titanium, |
| 1.3 | percent molybdenum, |
| 3.8 | percent tungsten, |
| 2.8 | percent tantalum, |
| 0.016 | percent boron, |
| 0.08 | percent carbon, |
| 0.02 | percent zirconium, and |
| | balance substantially nickel. |

8. A method according to claim 1, wherein said melt consists essentially of:

| | |
|---|---|
| 14.0 | percent chromium, |
| 9.5 | percent cobalt, |
| 3.0 | percent aluminum, |
| 5.0 | percent titanium, |
| 1.5 | percent molybdenum, |
| 4.0 | percent tungsten, |
| 3.0 | percent tantalum, |
| 0.015 | percent boron, |
| 0.13 | percent carbon, |

-continued

| | |
|---|---|
| up to 0.03 | percent zirconium, and balance substantially nickel. |

9. A method for producing a large, hot tear-free superalloy gas turbine bucket useful in a large, land-based utility gas turbine engine, said process comprising the steps of:

providinga melt of a superalloy consisting essentially of, by weight:

| | |
|---|---|
| 14.0 | percent chromium, |
| 9.5 | percent cobalt, |
| 5.0 | percent titanium, |
| 3.0 | percent aluminum, |
| 4.0 | percent tungsten, |
| 2.5 | percent molybdenum, |
| 0.016 | percent boron, |
| 0.03 | percent zirconium, |
| 0.15 | percent carbon, |
| 2.0 | percent tantalum, balance substantially nickel; and casting said melt to produce said large gas turbine bucket. |

10. A method for producing a large, hot tear-free superalloy gas turbine bucket useful in a large, land-based utility gas turbine engine, said process comprising the steps of:

providing a melt of a superalloy consisting essentially of, by weight.

| | |
|---|---|
| 14.0 | percent chromium, |
| 9.5 | percent cobalt, |
| 5.0 | percent titanium, |
| 3.0 | percent aluminum, |
| 4.0 | percent tungsten, |
| 2.0 | percent molybdenum, |
| 0.016 | percent boron, |
| 0.03 | percent zirconium, |
| 0.15 | percent carbon, |
| 2.5 | percent tantalum, balance substantially nickel; and casting said melt to produce said large gas turbine bucket. |

11. A method for producing a large, hot tear-free superalloy gas turbine bucket useful in a large land based utility gas turbine engine, said process comprising the steps of:

providing a melt of a superalloy consisting essentially of, by weight:

| | |
|---|---|
| 14.0 | percent chromium, |
| 9.5 | percent cobalt, |
| 5.0 | percent titanium, |
| 3.0 | percent aluminum, |
| 4.0 | percent tungsten, |
| 1.5 | percent molybdenum, |
| 0.016 | percent boron, |
| 0.03 | percent zirconium, |
| 0.15 | percent carbon, |
| 3.0 | percent tantalum; balance substantially nickel; and casting said melt to produce said large gas turbine bucket. |

12. A method for producing a large hot tear-free superalloy gas turbine bucket useful in a large, land-based utility gas turbine engine, said process comprising the steps of:

providing a melt of a superalloy consisting essentially of, by weight;

| | |
|---|---|
| 14.0 | percent chromium, |
| 9.5 | percent cobalt, |
| 5.0 | percent titanium, |
| 3.0 | percent aluminum, |
| 3.0 | percent tungsten, |
| 2.0 | percent molybdenum, |
| 0.015 | percent boron, |
| 0.03 | percent zirconium, |
| 0.12 | percent carbon, |
| 2.5 | percent tantalum, balance substantially nickel; and casting said melt to produce said large gas turbine bucket. |

13. A method for producing a large, hot tear-free superalloy gas turbine bucket useful in a large, land-based utility gas turbine engine, said process comprising the steps of:

providing a melt of a superalloy consisting essentially of, by weight:

| | |
|---|---|
| 14.0 | percent chromium, |
| 9.5 | percent cobalt, |
| 5.0 | percent titanium, |
| 3.0 | percent aluminum, |
| 4.0 | percent tungsten, |
| 2.5 | percent molybdenum, |
| 0.015 | percent boron, |
| 0.03 | percent zirconium, |
| 0.15 | percent carbon, |
| 2.0 | percent tantalum, balance substantially nickel; and casting said melt to produce said large gas turbine bucket. |

14. A method for producing a large, hot tear-free superalloy gas turbine bucket useful in a large, land-based utility gas turbine engine, said process comprising the steps of:

providing a melt of a superalloy consisting essentially of, by weight:

| | |
|---|---|
| 14.0 | percent chromium, |
| 9.5 | percent cobalt, |
| 5.0 | percent titanium, |
| 3.0 | percent aluminum, |
| 4.0 | percent tungsten, |
| 1.5 | percent molybdenum, |
| 0.015 | percent boron, |
| 0.03 | percent zirconium, |
| 0.15 | percent carbon, |
| 3.0 | percent tantalum, balance substantially nickel; and casting said melt to produce said large gas turbine bucket. |

15. A method for producing a large, hot tear-free superalloy gas turbine bucket useful in a large, land-based utility gas turbine engine, said process comprising the steps of:

providing a melt of a superalloy consisting essentially of, by weight:

| | | | |
|---|---|---|---|
| 13.7 | to | 14.3 | percent chromium, |
| 9.0 | to | 10.0 | percent cobalt, |
| 4.8 | to | 5.2 | percent titanium, |
| 2.8 | to | 3.2 | percent aluminum, |
| 2.8 | to | 4.3 | percent tungsten |
| 1.0 | to | 1.5 | percent molybdenum, |
| 0.005 | to | 0.02 | percent boron, |
| 0 | to | 0.03 | percent zirconium, |
| 0.08 | to | 0.15 | percent carbon, and |

2.0 to 3.0 percent tantalum, or 1.0 to 1.5 percent columbium, or 2.0 to 2.5 percent hafnium, or 1.5 to 3.5 percent of a mixture of containing at least two of tantalum, columbium and hafnium, balance substantially nickel; and casting said melt to produce said large gas turbine bucket.

16. A method for producing a large, hot tear-free superalloy gas turbine bucket useful in a large, land-based utility gas turbine engine, said process comprising the steps of:

providing a melt of a superalloy consisting essentially of, by weight:

| | | | |
|---|---|---|---|
| 13.7 | to | 14.3 | percent chromium, |
| 9.0 | to | 10.0 | percent cobalt, |
| 4.8 | to | 5.2 | percent titanium, |
| 2.8 | to | 3.2 | percent aluminum |
| 2.8 | to | 4.3 | percent tungsten |
| 1.0 | to | 2.0 | percent molybdenum, |
| 0.005 | to | 0.02 | percent boron, |
| 0 | to | 0.03 | percent zirconium, |
| 0.08 | to | 0.15 | percent carbon, and |

2.0 to 3.0 percent tantalum, or 1.0 to 1.5 percent columbium, or 2.0 to 2.5 percent hafnium, or 1.5 to 3.5 percent of a mixture of containing at least two of tantalum, columbium and hafnium, balance substantially nickel; and casting said melt to produce said large gas turbine bucket.

17. A method for producing a large, hot tear-free superalloy gas turbine bucket useful in a large, land-based utility gas turbine engine, said process comprising the steps of:

providing a melt of a superalloy consisting essentially of, by weight:

| | | | |
|---|---|---|---|
| 13.7 | to | 14.3 | percent chromium, |
| 9.0 | to | 10.0 | percent cobalt, |
| 4.8 | to | 5.2 | percent titanium, |
| 2.8 | to | 3.2 | percent aluminum, |
| 2.8 | to | 4.3 | percent tungsten, |
| 1.0 | to | 2.5 | percent molybdenum, |
| 0.005 | to | 0.02 | percent boron, |
| 0 | to | 0.03 | percent zirconium, |
| 0.08 | to | 0.15 | percent carbon, and |

2.0 to 3.0 percent tantalum, or 1.0 to 1.5 percent columbium, or 2.0 to 2.5 percent hafnium, or 1.5 to 3.5 percent of a mixture of containing at least two of tantalum, columbium and hafnium, balance substantially nickel; and casting said melt to produce said large gas turbine bucket.

* * * * *